United States Patent [19]

Lansberry et al.

[11] 4,323,280

[45] Apr. 6, 1982

[54] REMOTE CONTROLLED HIGH WALL COAL MINING SYSTEM

[75] Inventors: John B. Lansberry, Woodland; Jerome Apt, Jr., Pittsburgh; Joseph D. Dury, Jr., Sewickley, all of Pa.

[73] Assignee: Coalex, Inc., Woodland, Pa.

[21] Appl. No.: 24,371

[22] Filed: Mar. 27, 1979

Related U.S. Application Data

[63] Continuation of Ser. No. 746,190, Nov. 30, 1976, abandoned.

[51] Int. Cl.[2] ..... E21C 27/24

[52] U.S. Cl. ..... 299/1; 299/18; 299/30; 299/64; 285/97

[58] Field of Search ..... 299/1, 18, 19, 30, 56, 299/57, 64; 302/64; 285/97

[56] References Cited

U.S. PATENT DOCUMENTS

| | | | |
|---|---|---|---|
| 3,333,893 | 8/1967 | Heimaster | 299/1 |
| 3,362,752 | 1/1968 | Densmore | 299/18 |
| 3,602,551 | 8/1971 | Velegol | 302/64 |
| 3,722,556 | 3/1973 | Jeffers et al. | 285/97 |
| 3,892,443 | 7/1975 | Arentzen | 299/76 X |
| 3,947,980 | 4/1976 | Andrews et al. | 299/18 X |

FOREIGN PATENT DOCUMENTS

| | | | |
|---|---|---|---|
| 2416947 | 10/1975 | Fed. Rep. of Germany | 299/1 |

OTHER PUBLICATIONS

Werner, "Cable and Wireless Remote Control of Continuous Miners", Mining Congress-Journal 10-74, pp. 34-39.

*Primary Examiner*—Ernest R. Purser

*Attorney, Agent, or Firm*—Cushman, Darby & Cushman

[57] ABSTRACT

A high wall mining system including a continuous mining machine, a remote control station outwardly of the high wall from which extend electric cables wound on cable reels which extend to the continuous mining machine enabling the operator to control the machine based upon television pictures transmitted to the control station from television cameras on the machine and the signals from laser and sonar guidance systems provided at the control station in cooperation with elements on the continuous mining machine and an extensible and retractable vacuum air conveyor system for the coal recovered by the mining machine.

23 Claims, 17 Drawing Figures

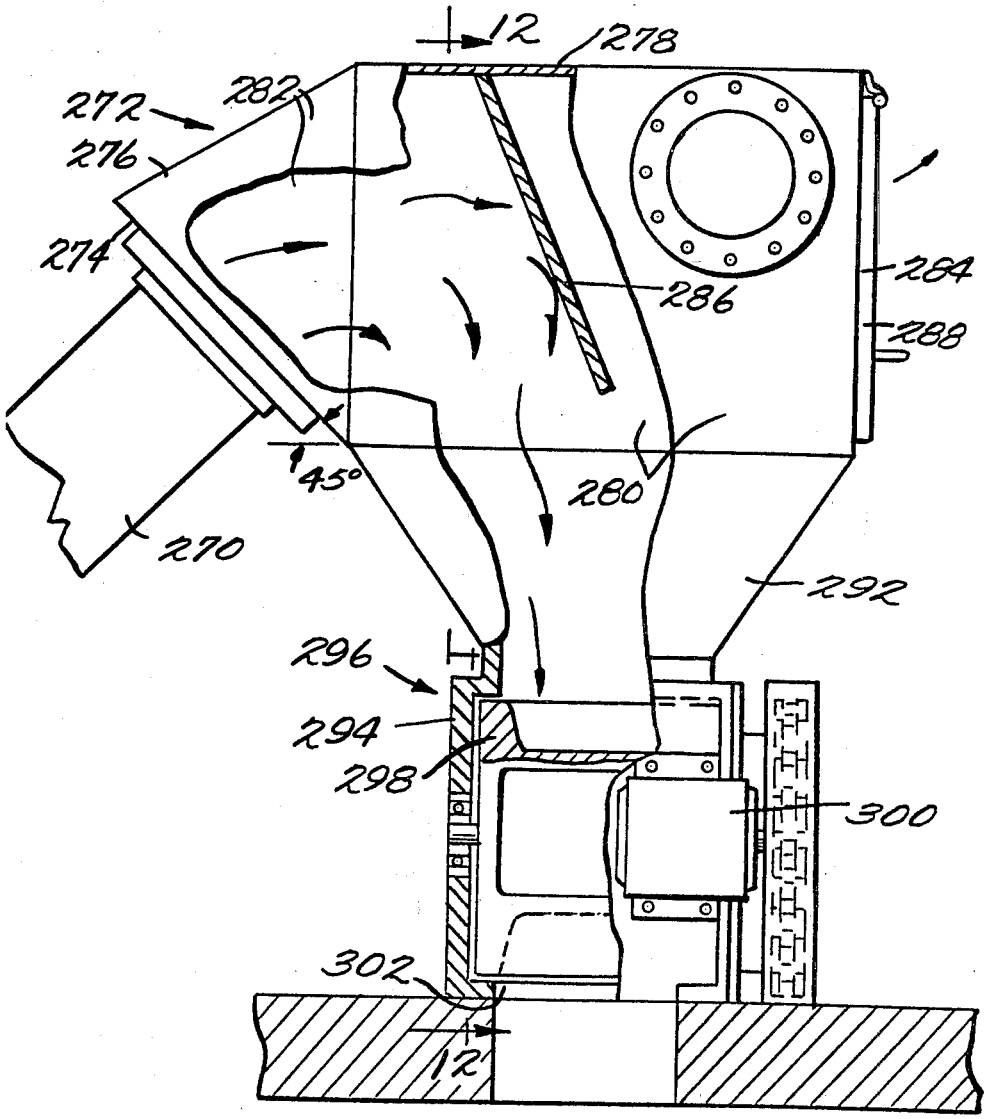
Fig. 11.
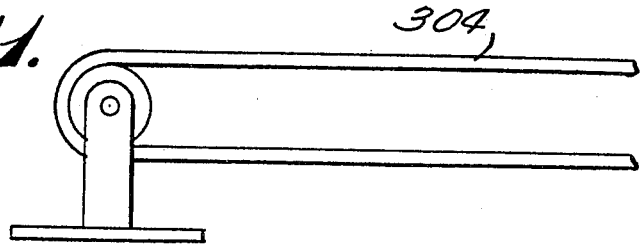

REMOTE CONTROLLED HIGH WALL COAL MINING SYSTEM

This is a continuation of application Ser. No. 746,190 filed Nov. 30, 1976, now abandoned.

This invention relates to mining and more particularly to an improved system for recovering coal from a seam without the necessity of utilizing personnel within the seam as the coal recovery progresses inwardly.

Strip mining in mountainous areas often results in the formation of a horizontal surface which is at the level of the seam in a mountainside or the like and a vertical surface which exposes the seam and the overburden thereabove. When the overburden reaches a predetermined height, further stripping inwardly of the seam is regarded to be uneconomical and the resultant vertical surface left is called a high wall. Where the high wall circumscribes a sufficiently large area and the coal seam is of sufficient thickness, normal conventional or continuous underground mining systems are employed for coal recovery. However, in a large majority of such situations, underground mining development is not feasible. Efforts to recover the coal in the seam exposed in such high wall conditions has been referred to as high wall mining.

One accepted high wall mining practice is augering. In the augering system, apparatus is set up on the horizontal surface which has the capability of rotating and advancing an auger cutting head into the seam and of permitting the auger cutting head to be extended and retracted by adding and subtracting additional auger sections. Of course, the amount of coal which can be recovered in this way is limited by the diameter of the auger cutting head and the inward extent to which the auger cutting head can be controlled. Generally, it can be stated that due to the tendency of the auger to droop and the high twisting stresses set up within auger sections, the system does not provide for an average inward extension of more than 150 feet.

Extensive efforts have been made over the years to provide a system which would be capable of overcoming the disadvantages inherent in auger high wall mining by providing for a greater amount of coal removal during the advance inwardly of the seam and by providing a more reliable and accurate system of guiding the cutting head inwardly of the seam, thus permitting the system to recover more coal per unit of advance and to advance a greater distance within the seam than is possible with current auger high wall mining technology. One such extensive effort is disclosed in Alsbaugh et al., U.S. Pat. No. 2,699,328 dated Jan. 11, 1955. In this system the cutting head utilized to remove the coal from the seam is a cutting head such as embodied in a conventional underground miner. An extensive system for controlling the advance of the continuous miner into the seam was provided (see the related patent to Heimaster et al., U.S. Pat. No. 2,761,666 dated Sept. 4, 1956) as well as an extensible and retractable sysem for effecting the conveyance of the coal outwardly of the seam to the working position outwardly of the high wall.

While it is applicants' understanding that the system as described in the above-identified patents was, in fact, operated in prototype form, no utilization of the system beyond the prototype form has been undertaken commercially. One problem encountered related to the conveying system. In this regard, reference is made to Densmore, U.S. Pat. No. 3,362,752 dated Jan. 9, 1968 which makes mention of the earlier Alsbaugh et al. system and specifically the cascading car conveyor system as being an area of the overall system needing improvement. By way of proposing a solution to the haulage problems, Densmore disclosed a vacuum air system capable of expansion and retraction to follow the advance and retreat of the continuous miner within the seam by providing for the assembly and disassembly of longitudinally mating split conduit sections around a fixed assembly providing for continuous inward extension. In this way, Densmore proposed to provide for the extension of the conduit system in a continuous manner without the necessity of shutting down the operation to effect such extension.

To applicants' knowledge, the Densmore vacuum air coal conveying system has not proven to be of sufficient improvement on the original Alsbaugh et al. system to effect any significant commercial usage. While it is evident that a remotely controlled high wall mining system such as Alsbaugh has the capability of prototype operation, there still remain problems with respect to the system which render it incapable of achieving an acceptable commercial level of operation.

It is the object of the present invention to provide an improved system which will have the capability of an acceptable commercial operation. Basically, this objective is obtained in accordance with the principles of the present invention by utilizing a new combination of elements, most of which are components of commercially proven capability.

The present system, like the comparable systems of the past, utilizes as the means for removing the coal from the solid an existing underground continuous miner. Insofar as the cutting cycle of the miner is concerned, the capability of controlling the operation of the miner through successive cutting cycles is achieved by providing for the extension and retraction of an electric cable through the operation of a suitable cable reel. In order to enable the remote operator to effect the cutting cycle within the seam appropriate fluorescent lighting and television cameras are provided on the miner so that the remote operator can actually see the operation of the miner in the seam as it is going through its cutting cycle. In order to permit the operator to maintain the miner in a straight course through the seam there is provided both a laser guidance system and a backup sonar guidance system. The laser system is utilized so long as there is line-of-sight access to the miner from the position outwardly of the high wall. The sonar system can be utilized in conjunction with the laser system as a check or by itself when such line-of-sight has been lost.

The present system further includes an improved vacuum air transport arrangement for the coal removed by the continuous miner. It is critical to the practical operation of the system to provide a positive displacement mechanism for establishing the vacuum source outwardly of the high wall. By utilizing a positive displacement air pump blockage of the system is effectively precluded. Major separation of the air entrained coal particles is achieved by a simple deflector type separator provided with a rotary air lock mechanism for discharging the solid particles therefrom. The air from the separator then flows through a hydrocyclone type filter, the solids discharge end of which is likewise provided with a rotary air lock discharge mechanism.

For purposes of enabling the conveying system to extend and retract with the advance and retraction of the continuous miner, there is provided a telescopic transfer mechanism which enables additional conduit sections having quick connect and disconnect assemblies at their ends to be added and subtracted to the conduit assembly extending to the continuous miner as the continuous miner is advanced and retracted. Preferably, the addition or subtraction of conduit sections is accomplished with air flow established through the filter and bypassing the telescopic transfer mechanism and the conduit assembly extending to the miner.

Accordingly it is a further object of the present invention to provide a remotely controlled high wall mining system which is efficient and reliable in operation and economical to manufacture and maintain.

These and other objects of the present invention will become more apparent during the course of the following detailed description and appended claims.

The invention may best be understood with reference to the accompanying drawings, wherein an illustrative embodiment is shown.

In the drawings:

FIG. 11 is an enlarged sectional view taken along the line 11—11 of FIG. 1;

Figure 1:
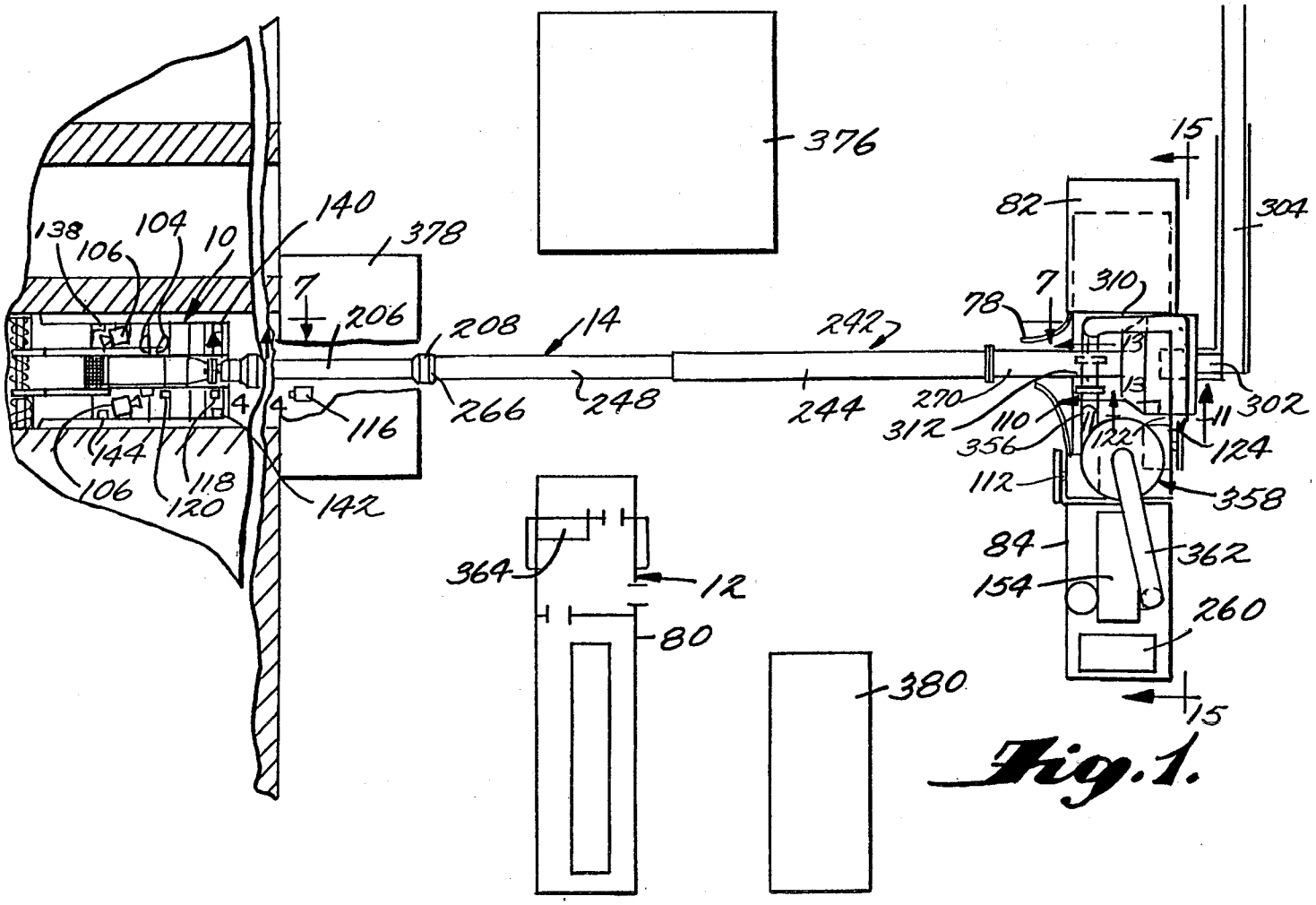
FIG. 1 is a top plan view of the high wall mining system of the present invention.

Referring now more particularly to FIG. 1 of the drawings, there is shown therein a high wall mining system which embodies the principles of the present invention. The system includes three basic component assemblies: (1) a continuous mining machine, generally indicated at 10, for advancing in the high wall seam; (2) a remote control guidance system 12 for controlling the movements of the continuous mining machine within the seam from a position outwardly of the high wall; and (3) an expansible and retractable vacuum air conveying system 14 connectable with the continuous mining machine 10 so as to be advanced in the seam thereby and to effect conveyance of the coal removed from the seam by the continuous mining machine to a position outwardly of the high wall.

Figure 14:
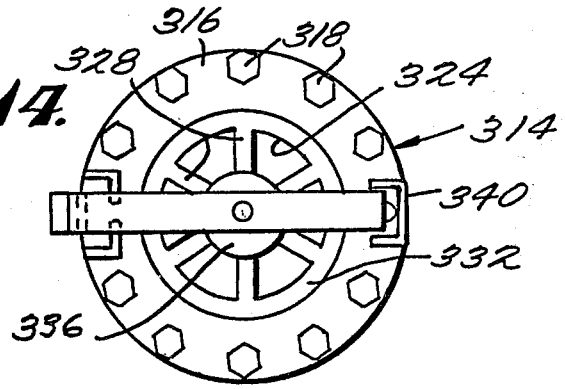
FIG. 14 is a view taken along the line 14—14 of FIG. 13.
Figure 16:
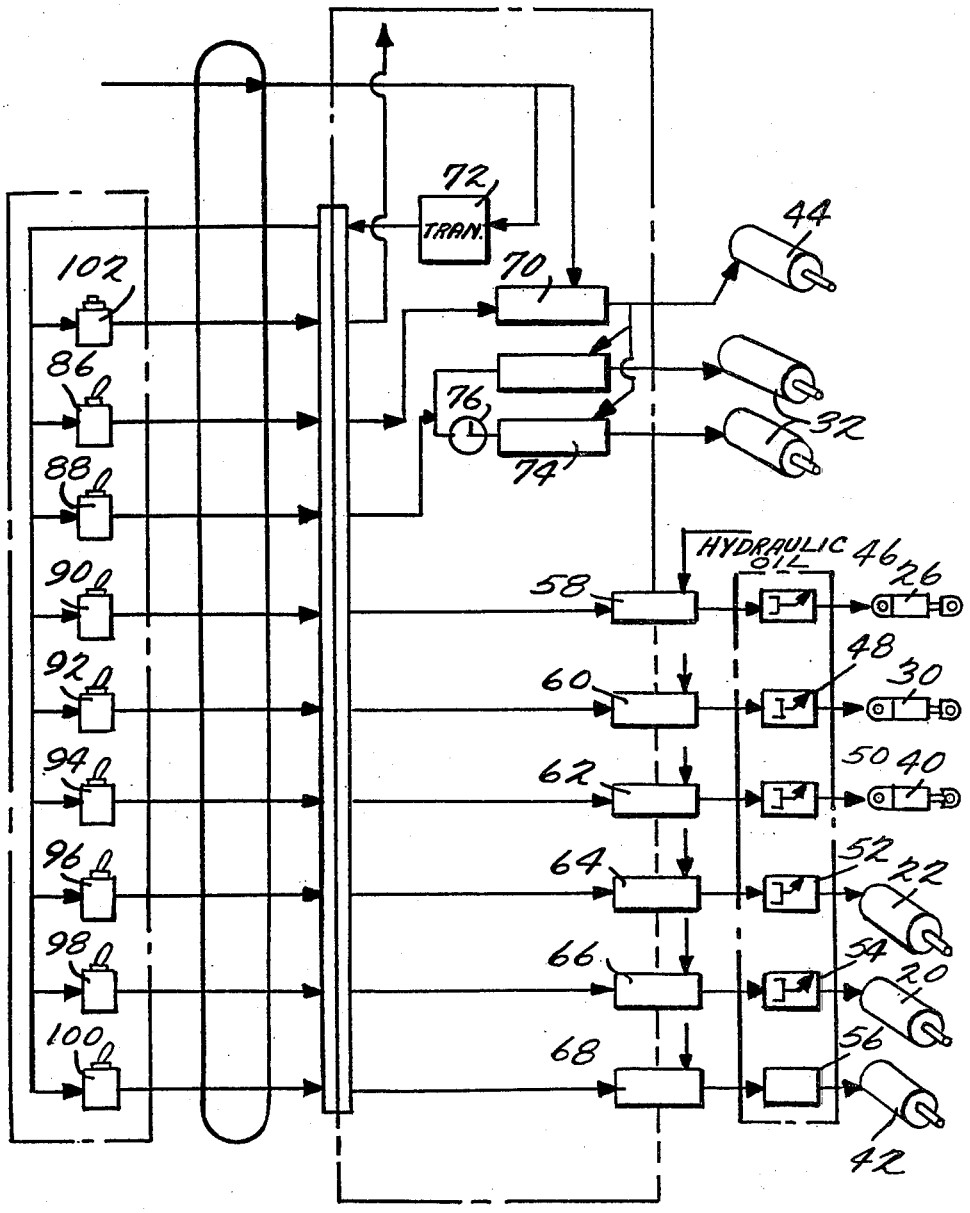
FIG. 16 is a somewhat schematic view illustrating the remote control system of the continuous mining machine.

The continuous mining machine 10 utilized in accordance with the principles of the present invention may be any of the known commercially available models. A preferred embodiment is the Model #101 Helimatic Miner, manufactured and sold by Dresser Industries, Jeffrey Mining Machine Division. For purposes of detailed disclosure of this machine reference is made to a brochure entitled "101MC Helimatic Continuous Mining System", the disclosure of which is hereby incorporated by reference into the present specification. FIG. 16 illustrates the remote control system schematic of this brochure modified for purposes of the present invention. Certain elements of the continuous mining machine 10 are disclosed in U.S. Pat. No. 3,892,443, the disclosure of which is also hereby incorporated by reference into the present specification. For present purposes it is sufficient to note that the continuous mining machine 10 includes a track frame 16 having left and right-hand endless track assemblies 18 driven by separated hydraulic motors, indicated schematically at 20 and 22 in FIG. 16. Mounted on the track frame 16 for horizontal longitudinal sliding movement is a sump frame 24. A pair of sump cylinders, indicated schematically at 26 in FIG. 16, is provided for effecting the reciprocating movement of the sump frame 24. Pivoted on the sump frame 24 about a transverse horizontal axis is an auger head assembly 28. The auger head assembly 28 is moved through raising and lowering movements about its pivotal axis with respect to the sump frame 24 by a pair of auger head cylinders, indicated schematically at 30 in FIG. 14, extending between the sump frame 24 and the auger head assembly 28. In addition, two electric motor drives, indicated schematically at 32 in FIG. 16, for the auger cutting head are also provided. Also mounted on the sump frame 24 for pivotal movement about a transverse axis parallel to the axis of pivotal movement of the auger head assembly 28 is a gathering assembly 34 which includes a laterally extending scraper type pick-up blade 36 for the auger cutters, auger head assembly 28 and a central conveyor 38. A pair of gathering cylinders, indicated schematically at 40 in FIG. 14, is provided between the sump frame 24 and the gathering assembly 34 for effecting raising and lowering movements of the gathering assembly 34 and permitting a floating movement thereof. In addition, a hydraulic motor, indicated schematically at 42 in FIG. 16, is provided for driving the central conveyor 38. The mining machine 10 as manufactured and sold is also provided with a chain conveyor assembly carried by the sump frame 24 for receiving the coal from the central conveyor 38 of the gathering assembly 34 and conveying the same rearwardly of the track frame 16. However, this chain conveyor is not utilized in practicing the present invention, as will be more apparent hereinafter.

With particular reference to FIG. 16 which is basically the remote control schematic of the brochure, as aforesaid, it will be noted that a third electric motor 44 is shown which drives the hydraulic pump (not shown) to provide hydraulic fluid under pressure for the various hydraulic motors and cylinders. The hydraulic cylinders 26, 30 and 40 and the hydraulic motors, 22, 20 and 42 are controlled by pilot operated main valves, indicated schematically at 46, 48, 50, 52, 54 and 56 respectively, and the pilot pressure to the main valves is controlled by solenoid operated valves, indicated schematically at 58, 60, 62, 64 66 and 68 respectively.

The electric motor 44 is provided with a starter 70 connected through a transformer 72 and the two auger motors 32 are provided with starters 74 which operate from a time delay relay 76. All of the above electrical components are connected to lines in a main cable 78 of extensive length forming a part of the remote control guidance system 12.

As best shown in FIG. 1, the guidance system includes a control station 80 which preferably embodies a construction similar to that of a conventional house trailer. As shown, the control station is located on the high wall bench adjacent the area of the seam of the high wall where the entry is to be developed. In this way, the control station can be moved along the bench parallel to the highwall as successive entries are developed.

The remote control guidance system 12 also includes as a component thereof a large diameter power operated cable reel 82 which is also adapted to be mounted in the area adjacent to and outwardly of the high wall of the seam in which operations are to take place. Preferably the mounting is one which renders the cable reel 82 portable so that it may also be moved along the seam as successive entries are worked. To this end, it is preferable to mount the cable reel 82 on a trailer body 84, the trailer body being of a type which forms one part of a conventional tractor-trailer truck assembly. The cable reel 82 is such that it can be rotated in either direction by an electric motor so as to either pay out or wind up an electric cable 78 thereon. It will be understood that the electrical cable 78 handled by the cable reel 82 is of a size such that it will not readily bend and hence the requirement for a large diameter reel. The manner in which the length of the cable extending inwardly from the high wall to the continuous miner 10 is handled will be described more fully hereinafter in conjunction with the description of the conveying system. The cable reel 82 provides for the capability of continuous electrical connection during the rotating movements thereof. Thus, the terminal end of the cable 78 wound thereon is preferably connected from the cable reel 82 to a control station 80. The control station thus provides for direct remote control operation of all of the functions of the machine 10 through the cable 78 carried by the cable reel 82.

As shown in FIG. 16, these functions are effected by eight electrical switches, indicated at 86, 88, 90, 92, 94, 96, 98 and 100 for controlling respectively electric motors 44 and 32, cylinders 26, 30 and 40 and hydraulic motors 22, 20 and 24. An emergency stop switch 102 is also provided.

Figure 17:
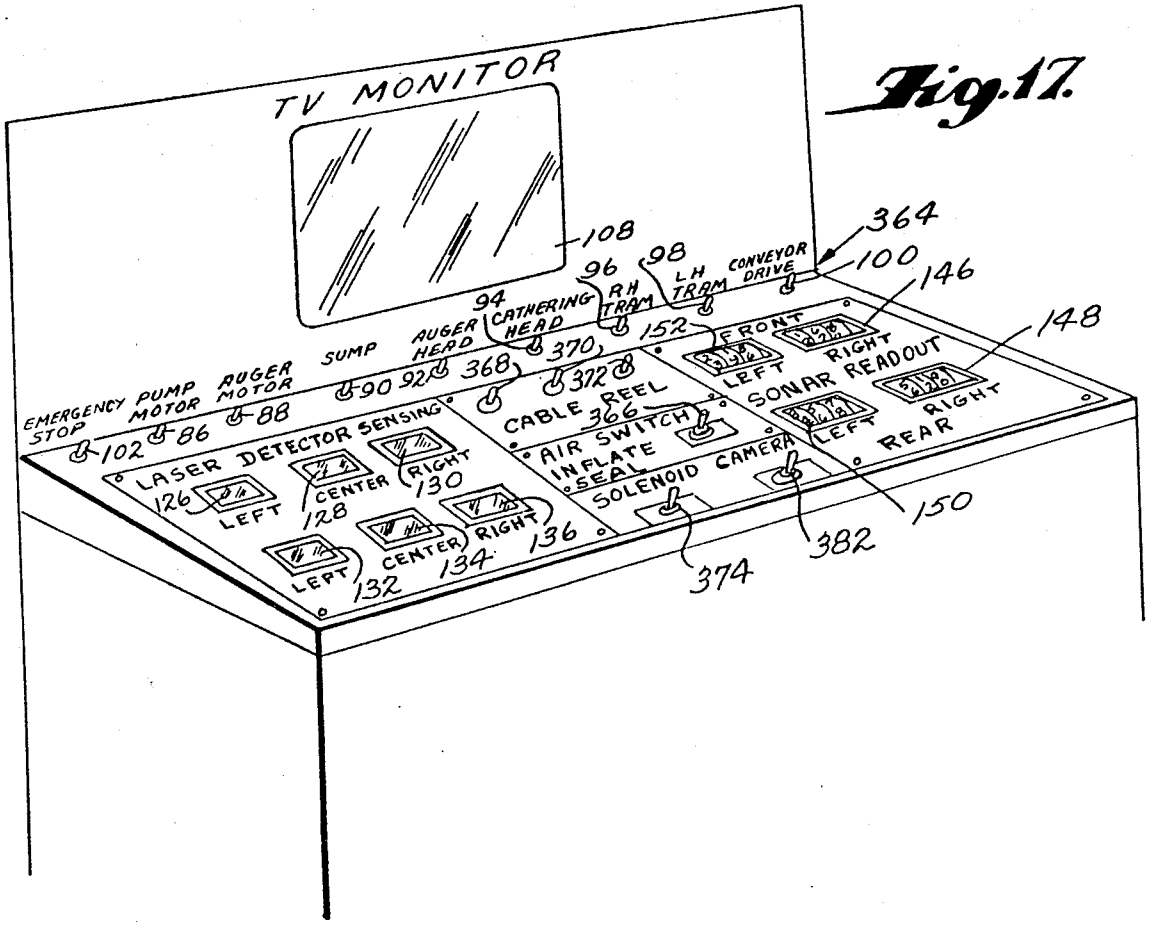
FIG. 17 is a somewhat schematic view illustrating the control panel of the control station.

In order to provide an operator situated at the control station 80 with the capability of operating the remote controls of the continuous mining machine 10 so as to maintain the machine 10 on a desired line of advance and retreat within the seam, the remote control guidance system 12 includes the provision of auxiliary lights 104 and front and rear television monitoring cameras 106 on the continuous mining machine 10 and a television monitoring receiver 108 at the control station 80 (see FIG. 17). For purposes of energizing the television camera lights 104 and television cameras 106, there is provided a length of coaxial cable 110 which is handled by a power driven cable reel 112, also suitably mounted on the trailer body 84. It will be understood that the television cameras and receivers are of the conventional low light cable type well known in the television arts. As before, the cable reel 112 is of the type which is adapted to maintain a continuous circuit while the cable is either paid out or wound onto the reel. As before, the terminal end of the cable 110 wound on the reel 112 extends to the control station 80.

It will be noted that the lights 104 are preferably of the fluorescent type and provide for a degree of illumination of portions of the space surrounding the mining machine 10 including both toward the working face as well as toward the rear thereof which is sufficiently greater than the lighting normally provided by the mining machine 10 to enable the television cameras 106 to pick up pictures which, when viewed by the operator at the control station 80, enables the operator to distinguish between the coal of the seam and the material (slate or the like) which forms the roof and floor of the entry being mined. While the present invention contemplates the utilization of a single television camera capable of being directed both rearwardly and forwardly, a preferred arrangement is to provide two wide-angled television cameras 106 on the track frame 16 of the mining machine 10 in fixed positions. This makes it possible to provide mounts which will dampen the vibrational shocks incident to the cutting action of the machine 10. Likewise, while it is contemplated that the number of receivers 108 at the control station 80 can be equal to the number of the television cameras 104, a preferable arrangement is to provide a suitable switch 114 which will enable the operator at the control station 80 to select which of the two television cameras 106 is to be operated and to be viewed. Basically, with this arrangement, the television cameras 106 and lights 104 associated with the face are used during the advancing movements of the mining machine 10 while the television cameras and lights associated with the rear of the macine 10 are used during the retracting movements of the machine 10 from the entry.

It will be seen that while the television lights, cameras, and monitoring sets provide the operator with a visual indication of whether or not the machine 10 is being advanced in the seam, additional means must be provided in order to enable the operator to have a basis for determining whether the advancing movements within the seam are in the desired straight line. To this end, the remote control guidance system 12 includes a rotating beam optical laser unit 116. The unit 116 may be of any well-known construction, a preferred embodiment is Model 900-1 made by Micro Grade Laser Systems, Inc.

As best shown in FIG. 1, the laser unit 116 is positioned just outside of the high wall face so that its beam is projected forwardly perpendicular to the face of the seam and parallel to the planned entry to be mined. Mounted on the track frame 16 of the mining machine 10 are two laser beam detectors 118 and 120. Each detector may be of any suitable construction, a preferred embodiment is a model compatible with the laser unit 116 in which each has three detecting zones or separate laser sensitive areas. As best shown in FIGS. 1–4, it will be noted that the two detectors 118 and 120 are mounted on the track frame 16 of the continuous mining machine 10 so that they are aligned in a common vertical plane which is parallel to the center line of the machine 10. However, the two units 118 and 120 are spaced apart in a longitudinal horizontal direction with respect to the axis of the machine 10 and displaced vertically so as to enable the forwardmost unit to have a direct line to the laser unit 116.

The detectors 118 and 120 are provided with readout and light indicator circuitry (not shown). The light indicator of the units mounted on the miner 10 are in a position such that they can be picked up by the rearwardly directed television camera 106. The indicator circuitry of the detectors 118 and 120 is connected to the control station 80 by a sufficient length of cable 122 controlled by a power driven cable reel assembly 124. As before, the cable reel 124 is mounted on the trailer body 84 and the end of the cable 122 on the reel 124 provides for continuous energization during the cable reel movements and connection to the control station 80.

The projected rotating laser beam from the unit 116 strikes the detectors 118 and 120 which are mounted horizontally on a line which is parallel to the center line of the miner 10, but on different horizontal planes. Each detector 118 is connected to its own control readout unit (not shown) which supplies the power to operate the detector circuits and contains the circuitry to receive and translate the signals from each of the three detector zones. These units then transmit these signals to their respective three light indicators and the lines of the cable 122. The cable 122 transmits the signals of the eight indicators of the detectors to six lights 126, 128, 130, 132, 134 and 136 (see FIG. 17) which are illuminated in exactly the same sequence as the lights on the two three-light indicators of the detectors 118 and 120 located on the mining machine 10.

Thus, lights 126, 128 and 130 represent the left-hand, center and right-hand laser sensitive areas of the detector 118 118 while lights 132, 134 and 136 represent the comparable areas of detector 120.

If the machine 10 moves in either direction along the straight line formed by the three points of (a) the laser unit 116, (b) the most rearward detector 118, and (c) the other detector 120, then the center zones of both detectors will be energized and the center lights of both three-light detectors and the center lights 128 and 134 at the operator station 80 will be illuminated. Should the machine 10 stray from this straight line (in the horizontal plane) then some other sequence of lights would be illuminated. For example, should the machine 10 start to turn left (as viewed in FIG. 1) the right-hand detecting zone of detector 118 and the left-hand zone of detector 120 would be energized, lighting their respective indicating lights 130 and 132. This then instantly informs the operator of the misalignment and he then can take immediate remedial actions.

The laser system described above in conjunction with the television system provides the operator with the capability of remotely controlling the advancing movement of the continuous mining machine 10 into the seam both vertically so that the roof and floor of the entry being mined will be defined by the top and bottom of the seam, and horizontally so that the entry being mined will extend inwardly of the high wall along a straight line following the seam. So long as the seam is vertically straight and does not contain vertical undulations, the laser system will provide the capability of maintaining a straight entry through the seam.

For the purpose of providing a back-up guidance system in conjunction with the laser system as a check, or in lieu of the laser system in situations where the seam undulates and the line of sight of the laser has been lost, a sonar system is preferably also utilized. The sonar system includes four sonic transducers 138, 140, 142 and 144, which may be of any well-known commercial design mounted so that one is provided on each corner of the track frame 16 of the continuous mining machine 10. These sonic transducers are oriented so as to direct their sonic waves toward the adjacent rib or side wall of the entry being mined. The transducers may be of any conventional construction and operate in conventional fashion to send out periodic sonic wave pulses in the high frequency zone which strike the rib or side wall toward which they are directed and are reflected back to the transducer. The transducers are provided with circuitry which is capable of detecting the length of time that it takes the emitted sonic wave pulses to leave the transducer and be reflected back. The sonic waves are emitted on a continuing intermittent pulse basis separated by small fractions of a second. Since the mined or cut rib is not a smooth surface, one pulse may strike a protrusion on the rib and require less time to be reflected than another pulse that may strike a depression. Thus is becomes necessary to continuously average these measured time periods. This is accomplished in any well-known manner, as for example by electronically integrating the root mean square of the measured times that is required for each pulse to travel the path from the transducer to the rib and return. In this manner, it is possible to determine, on a continuous basis, the distance between each transducer and the rib toward which each is facing. This information is then transmitted to the control station 80, as by cable 122, and displaced, as by four digital read-out units 146, 148, 150 and 152 corresponding respectively to the transducers 138, 140, 142 and 144 at the control station 80. It will be understood that so long as the average readings of the read-out units are the same, the operator knows that the continuous mining machine 10 is moving in the desired straight line. When a variation in the read-outs is observed, the operator can then institute the appropriate action to insure the path is back on a straight line.

The extensible and retractable vacuum air conveying system 14 includes as a critical component thereof a positive displacement vacuum air pump, generally indicated at 154 in FIG. 1, which is preferably mounted on the trailer body 84, outwardly of the high wall. The air pump 154 may be of any conventional positive displacement design.

The pump unit provides on its suction side a vacuum air source for the system 14 which is transmitted to the continuous mining machine 10.

Figure 2:
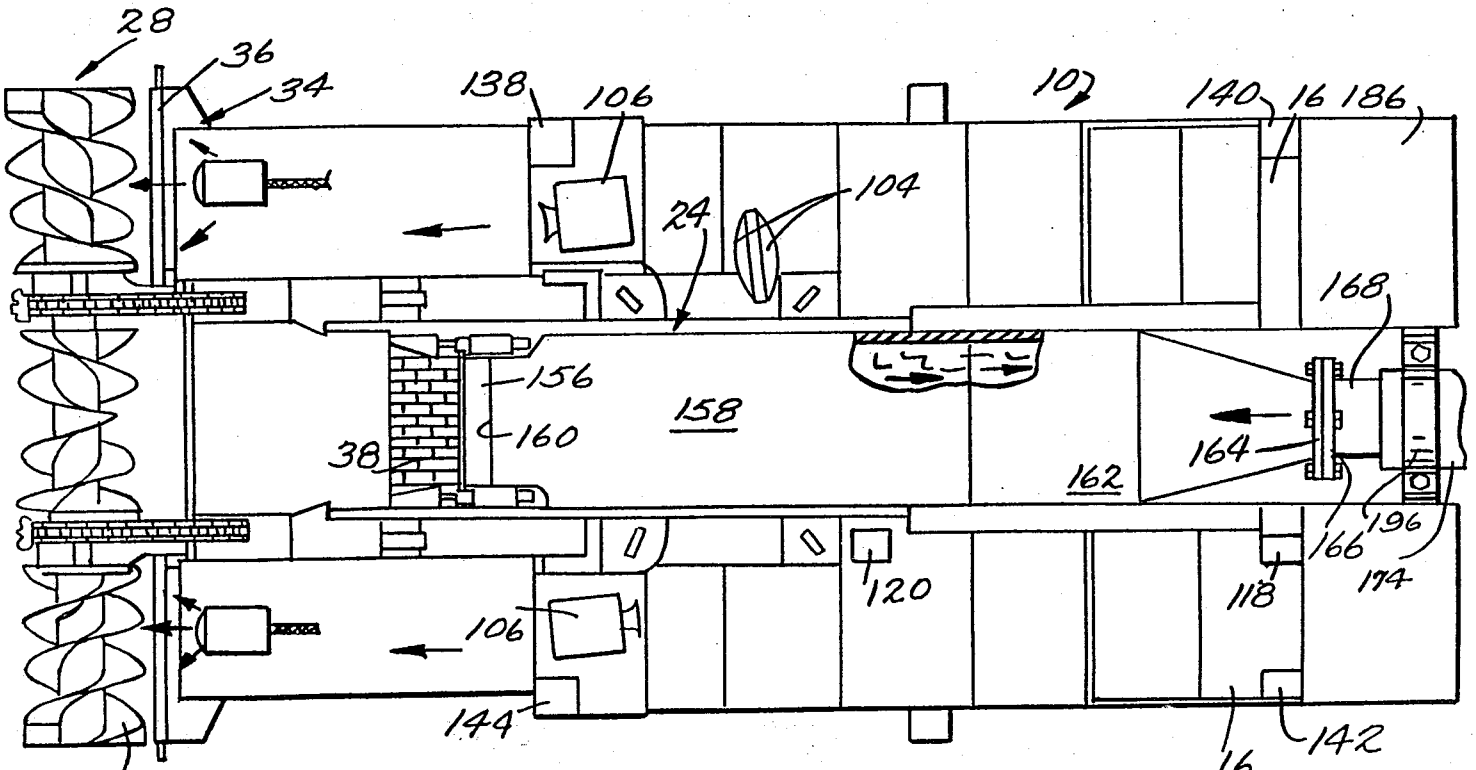
FIG. 2 is a top plan view of the continuous mining machine of the system.
Figures 3, 4:
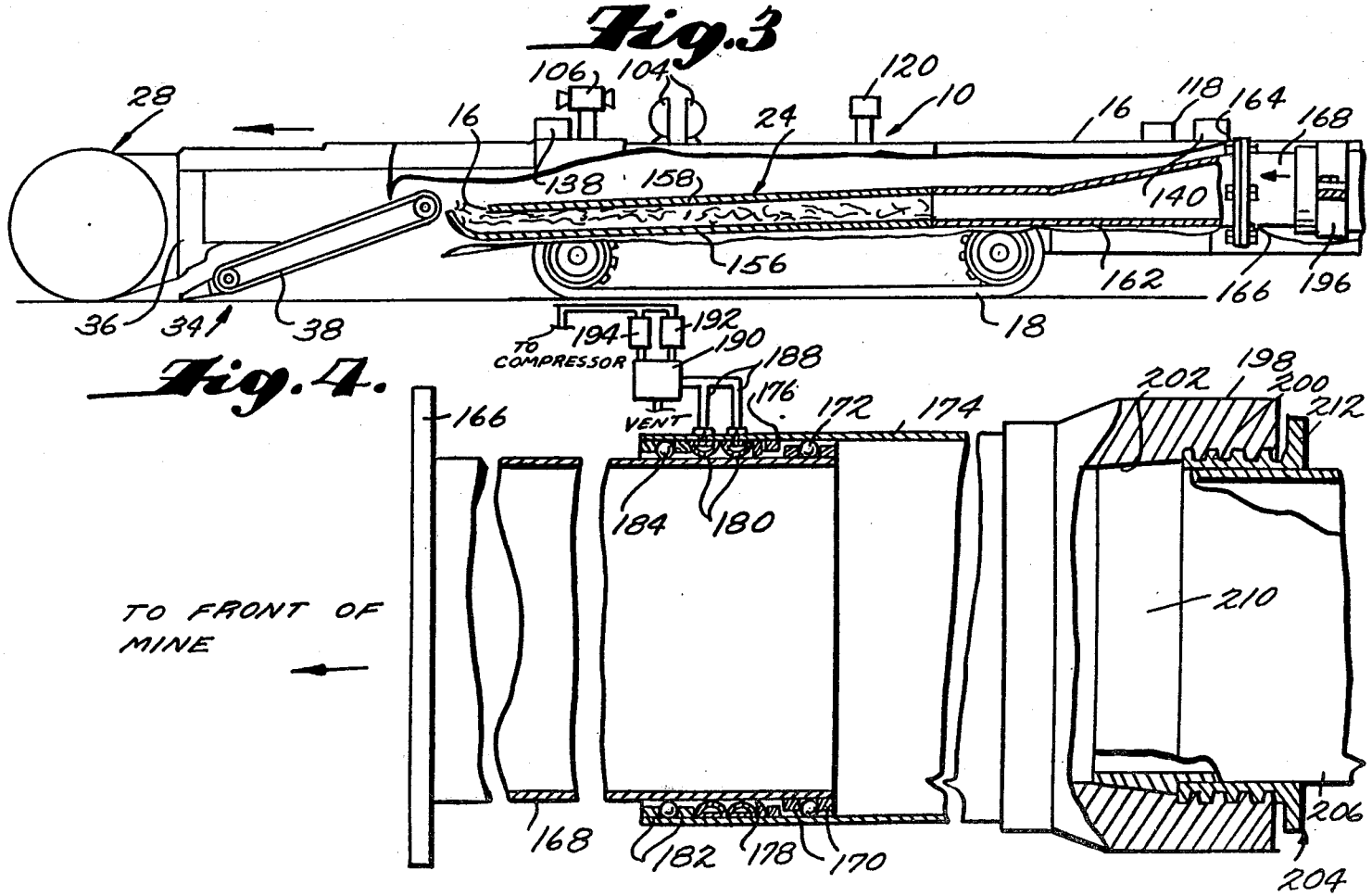
FIG. 3 is a side elevational view, with certain parts shown in section, for purposes of clearer illustration of the continuous mining machine shown in FIG. 2.
FIG. 4 is an enlarged fragmentary sectional view of the slip joint in the vacuum air conveying system components carried by the continuous mining machine.

With reference now to FIGS. 2 and 3, the inlet of the vacuum air system 14 is provided on the continuous mining machine 10 in lieu of the chain conveyor normally provided on such machine as aforesaid. It will be noted that the sump frame 24 of the machine 10 provide a box-like construction on which the components of the chain conveyor are normally mounted. As best shown in FIG. 3, the structure is provided by a bottom plate 156, the forward end of which curves upwardly along the radius and terminates at a position just rearwardly of the discharge end of the central conveyor 38 of the gathering assembly 34. A top plate 158 normally provides for the movement of the top flight of the chain conveyor thereover also is provided. The forward edge of the top plate 158 is spaced rearwardly from the forward upwardly curving edge of the bottom plate 156 so as to provide an inlet opening 160 into which the coal discharging from the central conveyor 38 is deposited. In modifying the existing commercial continuous mining machine to accommodate the vacuum air conveying system of the present invention, the rearward edges of the plates 156 and 158 are welded in sealed relation with the forward edge of a transition duct 162. The transition duct 162 is thus fixed to the sump frame and extends rearwardly thereof and terminates in a circular ring flange connector 164. Connected to the ring flange 164 as by a cooperating ring flange 166 and suitable bolts, is a short section of pipe or tubing 168. The pipe 168 forms one component of a slip joint, best shown in FIG. 4, which accommodates the sumping horizontal reciprocating movement of the sump frame 24 with respect to the track frame 16 of the mining machine 10.

To this end, the rear end of the pipe 168 has a pair of axially spaced rings 170 fixed to the exterior periphery thereof, the rings having a series of balls 172 mounted therebetween. The balls 172 are adapted to engage the interior periphery of an outer pipe 174 which forms the other basic component of the slip joint. The outer pipe 174 includes a stop ring 176 fixed on the interior periphery thereof at a position inwardly of the forward end thereof. Disposed in outwardly spaced relation with the stop ring 176 is a garlock type annular seal 178. Disposed outwardly and adjacent the seal 178 is a pair of side-by-side inflatable seals 180. Finally, formed on the outer end of the inner periphery of the outer pipe 174 is a pair of retainer rings 182 similar to the rings 170 previously described which have a series of balls 184 mounted therebetween which engage the outer periphery of the inner pipe 168.

While it is within the contemplation of the present invention to provide the inflatable seals 180 with a sealed air charge of a predetermined pressure, as for example, 20 psi, a preferred arrangement is to provide for the selective pressurization of the inflatable seals so that the friction provided during times when the slip joint is moved can be varied to accommodate such movement. To this end, it will be noted from FIG. 2 that there is provided in back of the track frame 16 of the machine 10 a conventional air conditioning unit 186. The purpose of this unit 186 is to provide for a self-contained source for cooling the various components of the machine in lieu of the cooling system normally provided. The compressor of this system is preferably utilized to provide for a source of pressure for the inflatable seals 180. As shown schematically in FIG. 4, the seals 180 have inlets 188 connected together which inlets lead to an electrically operated three-position valve 190. In one position of the valve 190, the inlet lines 188 to the two inflatable seals are connected through a pressure regulator 192 to the air compressor source (not shown) of the cooling unit 186, the pressure regulator being set to provide an operating pressure of 20 psi when the three-position valve is in a position to communicate the pressure regulator to the inflatable seals. In a second position, the three-position valve 190 serves to communicate the inflatable seals 180 with a second pressure regulator 194, which is likewise connected to the air compressor source of the cooling unit. The pressure regulator 194 is set to control the pressure at a reduced value as, for example 10 psi. Finally, the three-position valve 190 in its third position is adapted to vent the inflatable seals to atmosphere.

Basically, the electrical controls for the three-position valve can be connected to operate with the sump cylinder 26 and control 58 therefor. Thus, when the control 58 for the sump cylinder 26 is actuated to advance the sump cylinders, the signal for this movement is connected to move the three-position valve 190 into its second position so that the pressure of the inflatable seals 188 during the sumping action of the machine will be 10 psi. When the sumping cylinders 26 are actuated to move in the opposite direction, the three-position valve 190 is simultaneously actuated to move the three-position valve 190 into its third position, thus venting the inflatable seals 188 to atmosphere during the tramming movement of the machine. The arrangement is such that the three-position valve 190 will be spring actuated to retain the same in its first position at all other times, thus providing a 20 psi pressure to the seals 188.

The rearward end portion of the outer pipe 174 is fixedly secured to the track frame 16 of the machine 10, as by a yoke construction 196, and has a female quick disconnect coupling 198 mounted on the rearward end thereof. Any well-known type of quick disconnect coupling cna be utilized. A preferred arrangement is the quick disconnect coupling marketed under the registered trademark PRONTO-LOCK II by Ciba-Geigy.

Figure 6:
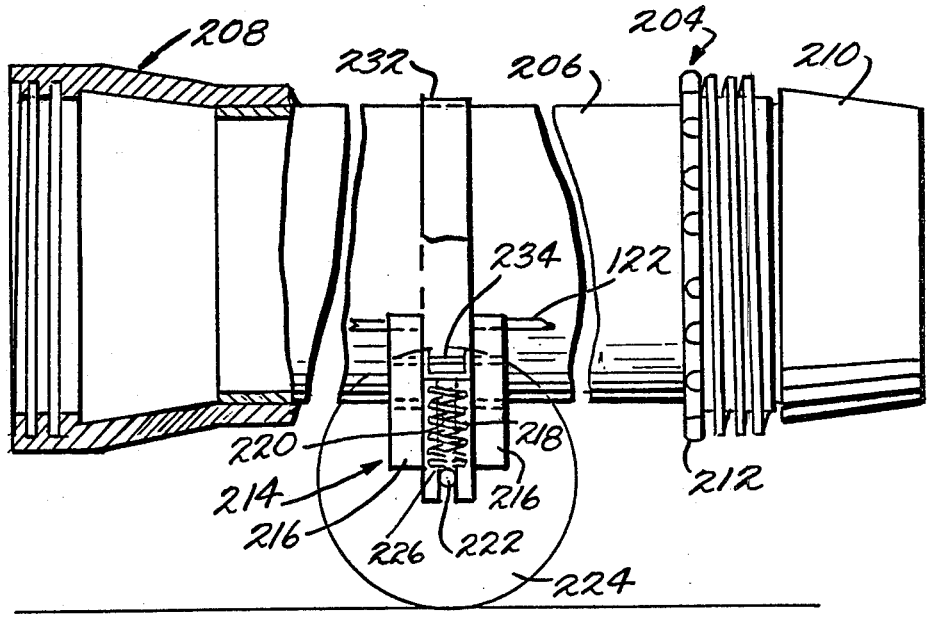
FIG. 6 is a sectional view taken along the line 6—6 of FIG. 5.

The female coupling 198 includes an enlarged socket having a series of internal threads 200 in its outer end portion and a frustoconical sealing surface 202 disposed inwardly thereof. The female coupling 198 is adapted to cooperate with a male quick disconnect coupling 204 formed on one end of a conduit section 206 having a similar female coupling 208 on the opposite end thereof. As best shown in FIGS. 4 and 6, the male coupling 204 includes an interior frustoconical sealing surface 210 on the end of the conduit 206 and a separate externally threaded sleeve 212 having threads adapted to cooperate with the socket threads 200 previously described.

The vacuum air conveyor system 14 is made expansible and retractable by the provision of a multiplicity of conduit sections 206 further selectively interconnected in end-to-end relationship so as to provide a conduit string which extends from the high wall inwardly of the seam to the continuous mining machine 10. Each of the sections 206 is constructed in the manner previously indicated which includes male and female quick disconnect couplings 204 and 208 on the ends thereof. Moreover, in order to reduce the frictional drag provided by the conduit string, and to enable it to more readily be moved inwardly in response to the advancing movements of the continuous mining machine 10, a wheeled carriage assembly, generally indicated at 214, is provided for each conduit section 206.

Figure 5:
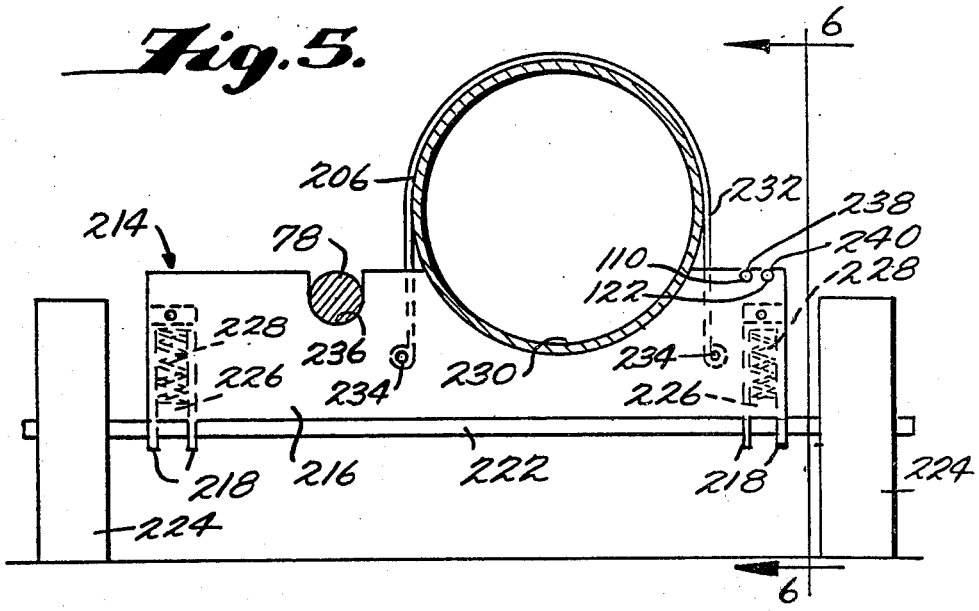
FIG. 5 is a sectional view of a conduit section showing a wheeled carriage assembly fixed thereto.

While the wheeled carriage assembly 214 may assume any desired configuration (for example, it may be constructed in the manner suggested in the aforesaid Densmore patent), a preverred construction is illustrated in FIGS. 5 and 6. As shown, the carriage assembly 214 includes a pair of frame boards 216 connected together in spaced relation by a pair of inverted U-shaped brackets 218. The brackets are open at their bottoms and are provided with vertically elongated transverse slots 220. Mounted within the slots 220 is an axle 222 having wheels 224 on the ends thereof. Fixedly mounted above the axle 222 within each bracket 218 is a spring seat element 226 on which is seated the bottom end of a coil spring 228. The upper end of each coil spring 228 seats on the upper surface of the associated bracket 218. This way the frame boards 216 are resiliently suspended on the axle.

The upper surfaces of the frame boards 216 are provided with aligned saddle-like recesses 230 of arcuate configuration adapted to receive the lower periphery of a conduit section 206. In order to insure a more positive gripping action between the pipe carriage assembly 214 and the conduit section 206 there is provided a strap 232 whose ends are suitably anchored to pins 234 carried by the frame boards 216. It will also be noted that the upper surfaces of the frame boards on one side of the main recesses 230 are provided with aligned recesses 236. These recesses are of a size to receive the main electrical cable 78 extending to the continuous mining machine which is handled by the cable reel 82. On the opposite side of the main recess there is formed in the upper surface of the frame boards a pair of spaced smaller recesses 238 and 240 to receive respectively the TV coaxial cable 110 which is handled by the cable reel 112 and the cable 122 for the laser and sonar guidance systems which is controlled by the cable reel 124. It will be understood that there is a wheeled carriage assembly 214 associated with each conduit section 206 as such section is added to the conduit string.

For purposes of adding conduit sections 206 to the conduit string, and for detaching conduit sections from the conduit string, there is provided a telescopic conduit transfer mechanism, generally indicated at 242. As best shown in FIGS. 7–10, the mechanism 242 includes an outer fixed pipe section 244 of a length greater than the length of the conduit sections 206. The outer pipe section 244 is mounted on the high wall bench outwardly of the high wall in a fixed position with its axis aligned with the inward direction of extent of the entry to be mined. Any suitable means may be provided for effecting this fixed positioning of the fixed outer pipe section. As shown, the pipe is fixedly supported on portable stands 246 at each end. The conduit transfer mechanism 242 also includes an inner pipe section 248 which likewise has a length which is greater than the length of the conduit sections 206. One end of the inner pipe section 248 is telescopically mounted within an adjacent end of the outer pipe section 244 and there is provided between the telescoping ends a slip joint which is similar to the slip joint previously described in connection with FIG. 4. Thus there are suitable ball bearings 250 and 252 provided on each section with a stop ring 254, a garlock type of seal 256 and a pair of inflatable seals 258.

In this instance, the arrangement with respect to the air circuitry to the inflatable seals 258 is simply an on-off type of circuitry in which air pressure from a suitable compressor 260 mounted on the trailer body 84 is directed through an appropriate pressure regulator 262 so as to provide an available source of 20 psi air. A simple two-way valve 264 is provided capable of electrical remote control which in one position communicates the 20 psi regulator with the inflatable seals and in the other position communicates the inflatable seals with atmosphere. In this instance, the arrangement is such that the valve 264 is turned to its second position communicating the seals to atmosphere only during the tramming movement of the continuous mining machine since the sumping movement is not transmitted by the operation of the machine to the conveying system.

It will be noted that the end of the inner pipe section 248 is provided with a male quick disconnect coupling 266 which mates with the female coupling 208 provided on each conduit section 210. To facilitate the telescopic movement of the inner pipe section 248 with respect to the outer pipe section 244, the inner pipe section 248 may be provided with a carriage assembly 214 adjacent its outer end and a suitable roller assembly 268 is provided adjacent the end of the outer pipe section 244 to rollingly support the opposite end of the inner pipe section 248 for telescopic movement within the outer pipe section.

Figures 7, 8, 9, 10:
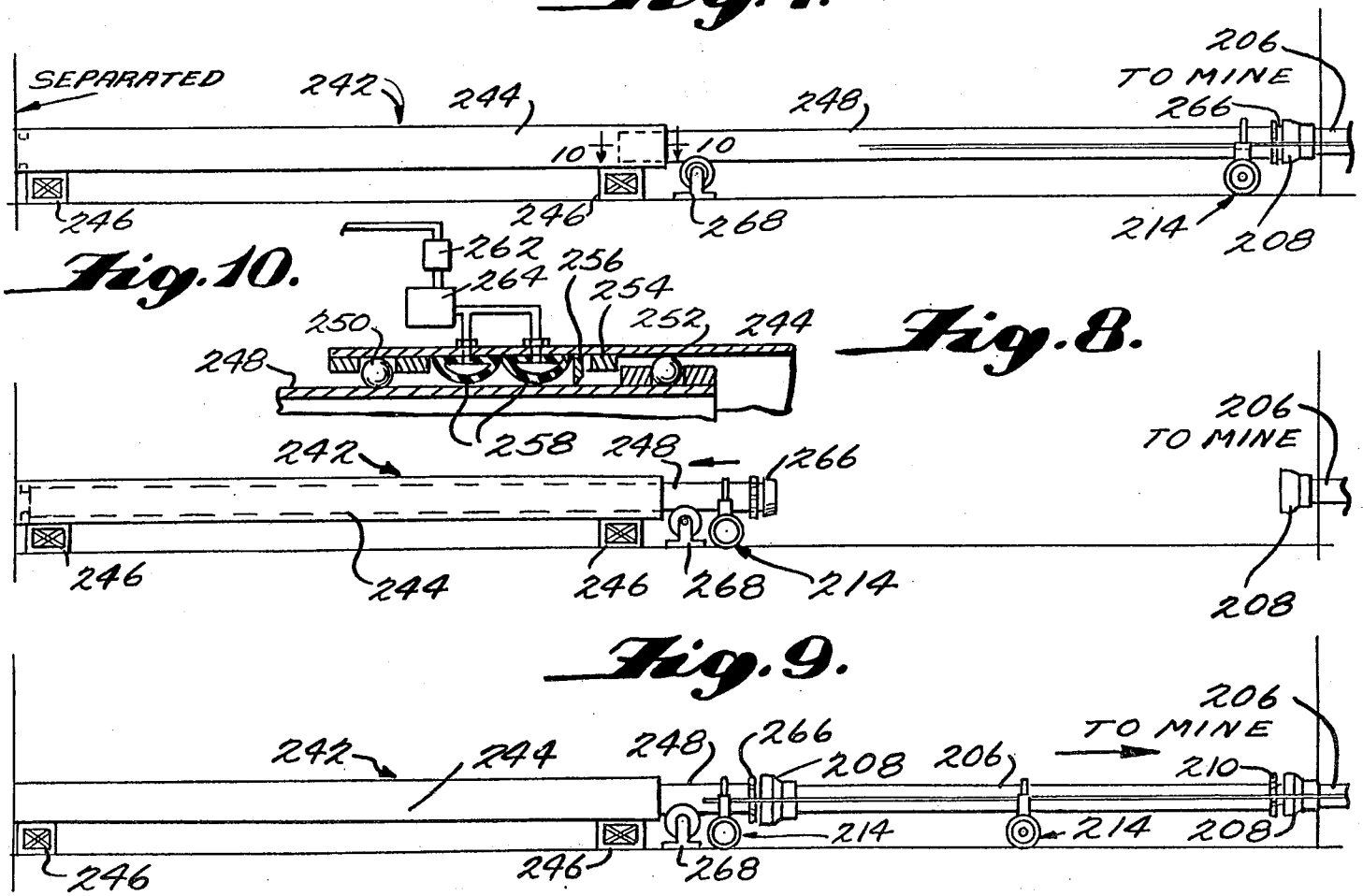
FIG. 7 is a side elevational view taken along the line 7—7 of FIG. 1 showing the telescopic conduit transfer mechanism in its fully extended position.
FIG. 8 is a view similar to FIG. 7 showing the mechanism in its retracted position preparatory to receiving a new conduit section.
FIG. 9 is a view similar to FIG. 8 showing the new conduit section attached.
FIG. 10 is an enlarged fragmentary sectional view taken along the line 10—10 of FIG. 7.

The mode of operation of the conduit transfer mechanism 242 in adding a conduit section 206 to the conduit string is illustrated in the stage views of FIGS. 7, 8 and 9. When the inner pipe section 248 has reached the end of its outward travel, as shown in FIG. 7, male coupling 266 is disengaged from the female coupling 208 of the last conduit section 206 of the conduit string. Next, the inner pipe section 248 is moved to the left as viewed in FIG. 7 until it extends almost entirely telescopically with the outer pipe section 244, as shown in FIG. 8, leaving the male coupling 266 on the end thereof spaced from the female coupling 208 of the last conduit section 206 of the conduit string a distance sufficient to move a new conduit string a distance sufficient to move a new conduit section 206 supported at its central portion by a wheeled carriage assembly 214, therebetween. Finally, the new conduit section is added to the conduit string as shown in FIG. 9, by connecting the female coupling 208 thereof with the male coupling 266 and the male coupling 210 thereof with the female coupling 208 of the last conduit section 206 of the conduit string.

Figure 12:
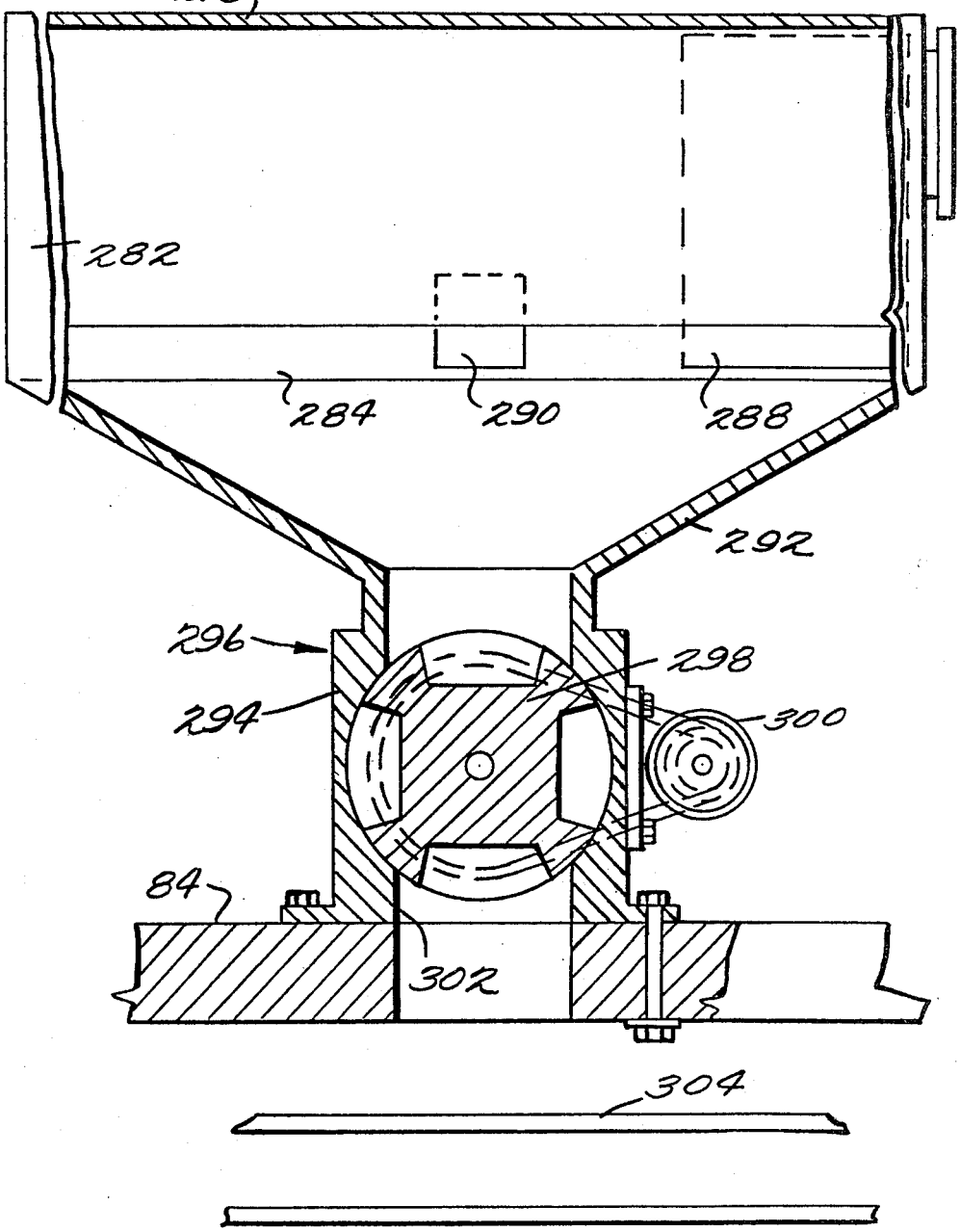
FIG. 12 is a sectional view taken along the line 12—12 of FIG. 11.

As best shown in FIG. 1, the opposite end of the outer pipe section 244 has a pipe 270 connected thereto which has a central bend therein so as to extend upwardly and outwardly. The end of this pipe section connects with the inlet side of a separator assembly, generally indicated at 272. As best shown in FIGS. 11 and 12, the separator assembly 272 includes a front inclined inlet wall 274 (e.g. 45°) which has an opening therein which receives a flanged connection formed on the end of the pipe section 270. Extending upwardly and outwardly from the upper edge of the front wall is an inclined transition top wall 276. The inclined transition top wall 276 has a top housing wall 278 connected to the edge thereof which top wall is of generally rectangular configuration. The separator assembly 272 also includes a pair of side housing walls 280, extending downwardly from the side edges of the top wall and suitable triangular shaped transition side walls 282 are connected between the leading edges of the side walls 280 and the side edges of the front wall 274. Finally, the rear edges of the top wall 278 and side walls 280 are enclosed by a rear housing wall 284.

Extending between the side walls 280 and in engagement with the top wall 278 is a baffle plate 286. As shown, the upper edge of the baffle plate 28 is spaced inwardly from the forward edge of the top wall 278 in a position such that the particles in the air stream issuing from the pipe section 270 will impinge thereon. The baffle plate 286 extends downwardly from its upper edge and in a direction away from the pipe at an angle of approximately 68° with respect to the top wall 278. The lower edge of the baffle plate terminates at a point spaced above the lower surfaces of the side walls 280, rear wall 284 and front wall 274. Access to the housing provided by the walls thusfar described may be obtained by an openable and closable hatch 288 in the rear wall. A sight panel 290 may also be provided in the rear wall, see FIG. 12.

Extending downwardly from the lower edges of the housing is a hopper section 292 in the form of an inwardly and downwardly tapering four-sided prism. The lower edges of the hopper section 292 feed to the upper opening formed in a cylindrical housing 294 forming a part of a rotary air lock discharge valve or feeder unit, generally indicated at 296. Units of this type are well known and a preferred embodiment is the model #24X22SR produced by Sprout Waldren.

The unit 296 is schematically illustrated in FIGS. 11 and 12 as including a pocketed rotor 298 which is mounted within the cylindrical housing 294 and driven by the electric motor 300. The cylindrical housing 294 includes a lower discharge opening 302, the arrangement being such that as the rotor 298 is rotated by the motor 300, the pockets are filled from the hopper section 292 and are emptied as they pass the outlet opening 302. It will be understood that any suitable conveyor arrangement may be provided beneath the rotary valve outlet opening for the purpose of receiving the discharged particles and handling them from that point on. As best shown in FIG. 1, a belt-type conveyor 304 is shown extending beneath the trailer bed to receive the discharge from the rotary valve which extends through the trailer bed. The conveyor 304 serves to discharge the material on a further belt conveyor 306 extending along the bench at the high wall location.

Figure 13:
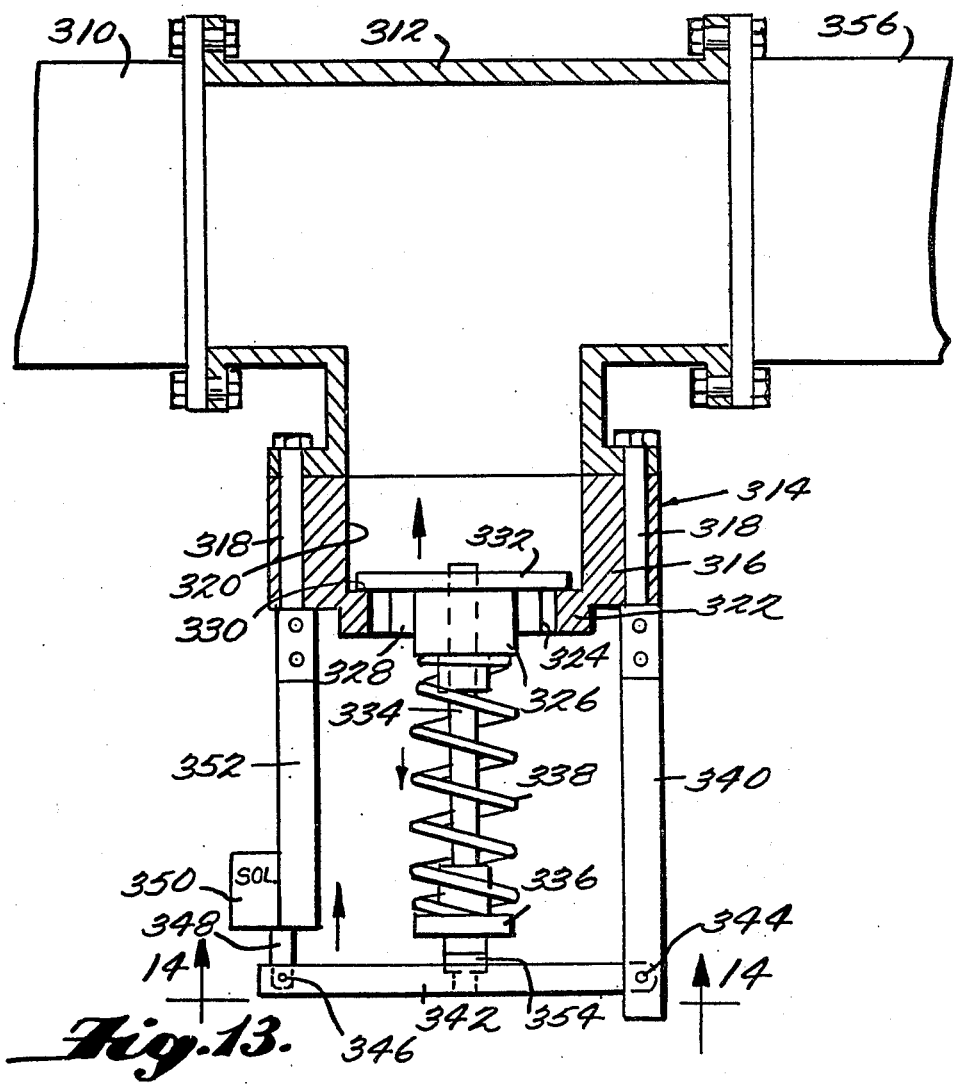
FIG. 13 is an enlarged fragmentary sectional view taken along the line 13—13 of FIG. 1.

It will be noted that one of the side walls 280 of the separator housing has an outlet opening 308 flanged to connect with a pipe assembly 310 which extends from the separator housing to a T-pipe connector, indicated at 312. As best shown in FIG. 13, the T-pipe connector 312 has the stem outlet thereof provided with a vacuum relief and by-pass valve mechanism, generally indicated at 314.

As best shown in FIGS. 13 and 14, the vacuum relief and by-pass valve assembly 314 includes a cylindrical valve body 316 adapted to mate with the flange of the stem connection of the T fitting 312. As shown, the valve body 316 is formed with a plurality of annularly spaced apertures for receiving a series of bolts 318 to effect the connection with the stem outlet of the T fitting. The central portion of the valve body 316 is provided with a cylindrical recess, as indicated at 320, which forms a relatively thin central end wall 322. The end wall has a series of annularly spaced openings 324 formed therein which provide in the end wall a central hub portion 326 and a plurality of spokes 328 as is clearly evident from FIG. 14. The interior surface of the end wall provides a valve seat 330 which is engaged by a disk valve member 332. The central portion of the valve member 332 is fixed to one end of a valve stem 334 which slidably engages through a central opening in the hub portion 326 and hence outwardly of the valve body 316.

The outer end of the valve stem 334 has a fitting 336 fixed thereto which serves to engage one end of a coil spring 338 disposed in surrounding relation to the valve stem 334. The opposite end of the coil spring 338 engages a suitable seat formed on the hub portion 326 of the end wall 322. Extending from the valve body 316 and fixed thereto by one of the bolts 318 is an elongated standard 340. The opposite end of the standard 340 pivotally receives one end of an actuating lever 342 as indicated at 344, the opposite end of which is pivotally connected, as indicated at 346, to the plunger 348 of a solenoid 350. As shown, the solenoid 350 is carried by the outer end of a standard 352 similar to the standard 340 fixed to the valve body 316 by an opposite bolt 318.

The central portion of the operating lever 342 is connected to the fitting 336 through a one-way connection bumper 354. In this way, the valve member 332 is operable to move inwardly from the closed position, as shown, against the bias of the spring 338 when the vacuum pressure conditions within the T fitting 312 reach a predetermined minimal value which is equivalent to that which may cause conduit collapse. This movement will take place without corresponding movement of the operating lever 342 taking place. Conversely, by energizing the solenoid 350, the plunger 348 is moved inwardly which in turn moves the operating lever 342 in a direction to positively engage the valve stem 334 and move the same together with the valve member 332 inwardly so that the valve member 332 is displaced from its seat 330, thus opening the interior of the system to atmosphere irrespective of the vacuum pressure conditions therein. Thus, by energizing the solenoid 350 the system as thusfar described is bypassed.

Figure 15:
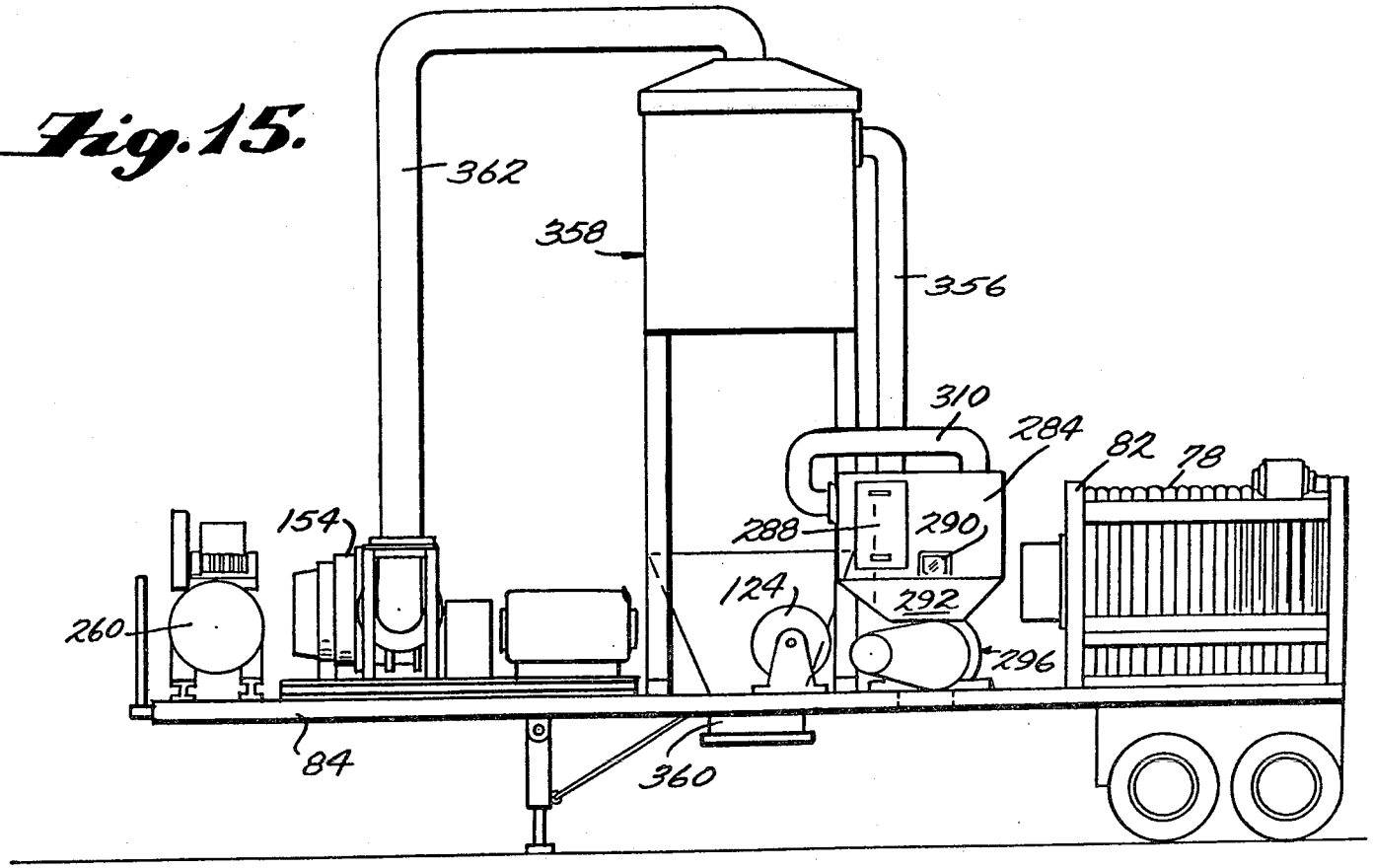
FIG. 15 is an enlarged elevational view taken along the line 15—15 of FIG. 1.

Referring again to FIG. 1 and to FIG. 15, it will be noted that the opposite branch of the T fitting 312 is communicated by a pipe assembly 356 to a tangential inlet of a filter assembly, generally indicated at 358. The filter assembly may be of any known construction. A preferred embodiment is the filter assembly Micropul model #109-10-20 manufactured by U.S. Filter Corporation. The bottom apex outlet of the hydrocyclone filter assembly 358 is provided with a rotary airlock valve assembly 360 which is similar to the asembly 296 previously described. The upper central air outlet of the filter assembly 358 is connected, as by a pipe assembly 362, to the inlet of the main positive displacement vacuum pump 154. It will be understood that the rotary airlock valve assembly 360 extends through the floor of the trailer in a manner similar to that previously described in connection with the assembly. Likewise a separate conveying system (not shown) for receiving the discharge from the filter assembly can be provided. It is contemplated that this discharge is considerably less than that of the feeder rotary airlock valve associated with the separator, hence the discharge can be separately handled. Moreover, it is also contemplated that the size of the particulate coal material discharged from the filter will be less than that in the separator and consequently maintaining this material separate from the discharge of the separator is considered desirable.

With reference to FIG. 17, there is shown therein a diagrammatic view of a control panel generally indicated at 364, which contains the various instrumentalities enabling an operator at the control station 80 to remotely control the entire system. It will be noted that the control panel includes the switches 86–102 by which the operation of the continuous mining machine can be controlled. In this regard, it will be noted that the normal operating cycle of the continuous mining machine 10 is as follows. With the gathering head cylinders 40 set by the switch 94 in a floating position and the auger head cylinders 30 set by the switch 92 in a raised position, sump cylinders 26 are actuated by the switch 90 to effect a forward movement of the sump frame with the auger head assembly 28 and gathering assembly 34 carried thereby into the coal seam. During this movement, as aforesaid, the inflatable seal 180 of the slip joint carried by the machine 10 is actuated so as to maintain a 10 p.s.i. value thereon. It will be understood that the sumping movement takes place with the track frame 16 in a stationary position. Consequently, during this movement the operator should have the selector switch for the television camera in a position to view the forwardly extending camera so that he will have a view of the seam as the cutting head advances therein along the roof. This will enable the operator to raise and lower the auger head if need be. The sumping distance is approximately 18 inches so that at the end of this movement the operator then lowers the auger head to the floor, again taking care by virtue of the television monitor to ensure that the coal in the seam is removed without digging into the floor. It will be understood that during the sumping movement and the lowering of the auger cutters all of the electrical motors 32 and 34 are energized as by switches 86 and 88. Likewise, the hydraulic motor 42 for the conveyor 38 is energized by the switch 100. At the end of the lowering movement of the auger head, the coal cut by the auger head 28 is soon removed from the conveyor 30 and placed in the air conveying system through the inlet 160. The operator can now simultaneously actuate the switch for the sump cylinders to reverse the same together with the switches 96 and 98 advancing the left and right hand tram motors 22 and 20. This actuation has the effect of venting the inflatable seals 180 to atmosphere and commencing the tramming action. Simultaneously with this movement the operator also actuates the switch venting the inflatable seals 258 of mechanism 242. In this regard note the switch 366 in FIG. 17. Note also switches 368, 370 and 372 for controlling the motors of the cable reels, 82, 112 and 124 respectively. It is during this tramming movement that the operator must carefully watch the laser lights 128 and 134 and the sonar readout indicators 146, 148, 150 and 152 if this system is in use.

At the end of approximately 13 cutting cycles, the machine 10 will have advanced a distance generally equal to the length of a conduit section 206. At this time, solenoid 350 is energized as by a switch 374 on the control panel. This has the effect of opening valve member 332 of the bypass valve assembly 314 thus establishing a vacuum air circuit from atmosphere through pipe 356, filter 358, pipe 362 and pump 154 which bypasses and cuts off the vacuum air flow in the entire system leading up to the valve 314. The transfer mechanism 242 can now be operated, as aforesaid, to add a new conduit section 206 having a carriage assembly 214 thereon. In this regard, note from FIG. 1 that a portable conduit section rack 376 is suitably stationed on the highwall bench. Note also the provision of a protective structure 378 for the entry opening which likewise can be moved. The other block schematically shown in FIG. 1 is a portable generator system 380 of conventional design.

After the new conduit section 206 has been secured the solenoid switch 374 and inflatable seal switch 366 are again actuated to reestablish the vacuum air circuit to the inlet opening 160 of the continuous mining machine 10.

It is contemplated that an advance of more than a thousand feet may be accomplished in two shifts after which it becomes necessary to retract the machine 10 from the mined entry so that the entire cycle can be commenced at the next entry.

In retracting the machine 10 the rear television camera is selected for viewing on the monitor set as by actuating switch 382 on the control panel. Retraction is accomplished by reversing the procedures previously described.

It thus will be seen that the objects of this invention have been fully and effectively accomplished. It will be realized, however, that the foregoing preferred specific embodiment has been shown and described for the purpose of illustrating the functional and structural principles of this invention and is subject to change without departing from such principles. Therefore, this invention includes all modifications encompassed within the spirit and scope of the following claims.

What is claimed is:

1. A remote controlled coal mining system comprising:

a continuous mining machine having power driven means thereon for moving said machine through successive coal cutting cycles which include an advancing movement along a mined entry in a direction toward the working face, cable means extending from said continuous mining machine to a remote control station, light means carried by said continuous mining machine for illuminating portions of the space surrounding said continuous mining machine including the mine seam face disposed forwardly thereof and adjacent portion of the mined entry rearwardly thereof, television camera means carried by said continuous mining machine for establishing electromagnetic signals indicative of the appearance of the illuminated space within the coal mine seam, means for transmitting the electromagnetic signals established by said television camera means to said control station, television receiver means at said control station operatively connected with said transmitting means for converting said signals to a continuous picture of the appearance of at least a selected portion of the illuminated coal mine space, means for moving a laser beam from a position adjacent said control station along at least two angularly related lines disposed within a common vertical plane perpendicular to the working face of the coal seam, first laser beam detector means carried by said continuous mining machine adjacent the rearward portion thereof, second laser beam detecting means carried by said continuous mining machine adjacent the forward portion thereof, said first and second detectors each including a central laser sensing area aligned respectively in the direction of said vertical plane but displaced vertically with respect to one another, so that said moving laser beam will strike the same along said lines so long as the advancing movement of said continuous mining machine is aligned with said vertical plane, said first and second detectors each including left and right-hand laser sensitive areas disposed horizontally to opposite sides of the associated central area, means for transmitting from said detectors to said control station signals indicative of the laser sensitive areas in the lines of said moving laser beam, and means at said control station connected with said cable means for enabling an operator at said control station to control the coal cutting cycle of said continuous mining machine based on the pictures provided by said television receiver means and the signals indicative of the laser sensitive areas in the lines of said moving laser beam whereby the coal cut during a cycle is cut between the mine roof and floor and the advancing movement is maintained in the direction of said vertical plane.

2. A system as defined in claim 1 including four sonic transducers mounted on opposite sides of said continuous mining machine at the forward and rearward portions thereof, each of said sonic transducers having means for directing successive sonic pulses laterally horizontally to the adjacent side wall of the entry being mined, means for receiving the return of successive sonic pulses from the side wall and of measuring the time of return as a function of distance, means for averaging the measurements of the receiving means of each transducer, and means for transmitting to said control station signal means indicative of the relative average measurements of the receiving means of said four transducers.

3. A system as defined in claim 1 including power operated reel means receiving said cable means in coils thereabout to be paid out and reeled up thereon in response to the power operated rotational movements thereof while said cable means is electrically connected.

4. A system as defined in claim 1 including an extensible and retractable vacuum air system for following the advance and retreat of said continuous mining machine in the coal seam and for conveying the coal cut from the seam by the continuous mining machine to a remote location comprising positive displacement air pump means having a suction side providing a source of vacuum air, a multiplicity of conduit sections each having means at each end thereof enabling successive sections to be sealingly interconnected in end-to-end relation to form a conduit string connected at one end to the continuous mining machine so as to receive coal particles cut and removed from the seam by said continuous mining machine, a telescopic conduit assembly connectible to the other end of said conduit string, coal particle separating means in series between said telescopic conduit assembly and the vacuum side of said positive displacement pump means, said coal particle separating means having rotary air lock discharge means for discharging the separated coal particles from the vacuum environment of the separating means without substantial effect on the pressure thereof, particle filter means in series between said separating means and the suction side of said positive displacement pump means having rotary air lock discharge means for discharging filtered particles from the vacuum pressure environment of the filter means without substantially effecting the pressure thereof, bypass valve means between said telescopic conduit assembly and said filter means normally disposed in a closed position to enable the source of vacuum pressure provided by the suction side of said positive displacement pump means to be communicated to said miner in a series vacuum air circuit through said conduit string, said telescopic conduit assembly, said separating means and said filter means and movable into an open position to provide a separate circuit through said open valve means in series with said filter means which bypasses said conduit string, and said telescopic conduit assembly, said telescopic conduit assembly being operable to permit said conduit string to be moved by said continuous mining machine during the advancing movement thereof while the vacuum air circuit is completed therethrough by virtue of said bypass valve means being in said closed position, said telescopic conduit assembly being operable to enable a conduit section to be added to said conduit string when said bypass valve means is in said open position to bypass the vacuum air circuit from said conduit string and said telescopic conduit assembly.

5. A system as defined in claim 4 wherein said separating means comprises a housing having an inlet for a stream of air having coal particles entrained therein, baffle means within said housing in a position to be engaged by said inlet stream of air and entrained coal particles for reducing the velocity energy of said coal particles and causing them to move downwardly in an abrupt change of direction, hopper means below said baffle means for collecting the coal particles moving downwardly from said baffle means, and air outlet means in said housing rearwardly of said baffle means and above said hopper means, said rotary air lock discharge means including a power driven pocketed rotor at the lower end of said hopper means.

6. A system as defined in claim 4 wherein said particle filter means comprises a body having a tangential inlet feed tube, an upwardly extending central air outlet conduit leading to the suction side of said positive displacement pump means, said rotary air lock discharge means comprising a power driven pocketed rotor disposed in a lower apex opening of said hydrocyclone body.

7. A system as defined in claim 4, wherein said telescopic conduit assembly includes a fixed pipe section, a movable pipe section telescopically related to said fixed pipe section, and means including an inflatable seal for sealing said telescopically related pipe sections.

8. A system as defined in claim 7 including means for introducing and exhausting air under pressure to said inflatable seal.

9. A system as defined in claim 4 wherein said by-pass valve means in its closed position is retained therein by a predetermined spring pressure yieldable when the vacuum within the system communicating therewith exceeds a predetermined valve.

10. A system as defined in claim 4 wherein a wheeled carriage assembly is fixed to the central portion of each conduit section.

11. A system as defined in claim 4 wherein said continuous mining machine includes a track frame, left and right-hand independently power driven endless track assemblies on said track frame for moving the same in either direction along a mine entry floor and for guiding the same during such movement, a sump frame mounted on said track frame for power driven horizontal reciprocating movement with respect to said track frame and track assemblies, coal cutting and gathering means carried by said sump frame for cutting the coal in a coal seam and for gatheringly moving the cut coal to a discharge position located at the central portion of the machine, an inlet vacuum air duct fixed to said sump frame having a forward inlet opening disposed at said discharge position and a rear end portion of constant cross-sectional configuration, a cooperating duct section fixedly carried by said track frame having a forward end portion of constant cross-sectional configuration disposed in telescopic relation with respect to the rear end portion of said inlet duct, and means for sealingly connecting said telescopically arranged portions while permitting telescopic movement to take place in response to the power driven movement of said sump frame.

12. A system as defined in claim 11 wherein said sealing means includes an inflatable annular seal and means for introducing air into said inflatable seal selectively at a plurality of predetermined elevated pressures and atmospheric pressure.

13. A remote controlled coal mining system comprising:

continuous mining machine having power driven means thereon for moving said machine through successive coal cutting cycles which include an advancing movement along a mined entry in a direction toward the working face, cable means extending from said continuous mining machine to a remove control station, light means carried by said continuous mining machine for illuminating portions of the space surrounding said continuous mining machine including the mine seam face disposed forwardly thereof and adjacent portion of the mined entry rearwardly thereof, television camera means carried by said continuous mining machine for establishing electromagnetic signals indicative of the appearance of the illuminated space within the coal mine seam, means for transmitting the electromagnetic signals established by said television camera means to said control station, television receiver means at said control station operatively connected with said transmitting means for converting said signals to a continuous picture of the appearance of at least a selected portion of the illuminated coal mine space, four sonic transducers mounted on opposite sides of said continuous mining machine at the forward and rearward portions thereof, each of said sonic transducers having means for directing successive sonic pulses laterally horizontally to the adjacent side wall of the entry being mined, means for receiving the return of successive sonic pulses from the side wall and of measuring the time of return as a function of distance, means for averaging the measurements of the receiving means of each transducer, and means for transmitting to said control station signal means indicative of the relative average measurements of the receiving means of said four transducers, and means at said control station connected with said cable means for enabling an operator at said control station to control the coal cutting cycle of said continuous mining machine based on the pictures provided by said television receiver means and the signals indicative of the relative average measurements of the receiving means of said four transducers whereby the coal cut during a cycle is cut between the mine roof and floor and the advancing movement is maintained in a straight direction.

14. A system as defined in claim 13 including power operated reel means receiving said cable means in coils thereabout to be paid out and reeled up thereon in response to the power operated rotational movements thereof while said cable means is electrically connected.

15. An extensible and retractable vacuum air system for following the advance and retreat of a continuous mining machine in a coal seam and for conveying the coal cut from the seam by the continuous mining machine to a remote location comprising positive displacement air pump means having a suction side providing a source of vacuum air, a multiplicity of conduit sections each having means at each end thereof enabling successive sections to be sealingly interconnected in end-to-end relation to form a conduit string connected at one end to the continuous mining machine so as to receive coal particles cut and removed from the seam by said continuous mining machine, a telescopic conduit assembly connectible to the other end of said conduit string, coal particle separating means in series between said telescopic conduit assembly and the vacuum side of said positive displacement pump means, said coal particle separating means having rotary air lock discharge means for discharging the separated coal particles from the vacuum environment of the separating means without substantial effect on the pressure thereof, particle filter means in series between said separating means and the suction side of said positive displacement pump means having rotary air lock discharge means for discharging filtered particles from the vacuum pressure environment of the filter means without substantially effecting the pressure thereof, bypass valve means between said telescopic conduit assembly and said filter means normally disposed in a closed position to enable the source of vacuum pressure provided by the suction side of said positive displacement pump means to be communicated to said miner in a series vacuum air circuit through said conduit string, said telescopic conduit assembly, said separating means and said filter means and movable into an open position to provide a separate circuit through said open valve means in series with said filter means which bypasses said conduit string, and said telescopic conduit assembly, said telescopic conduit assembly being operable to permit said conduit string to be moved by said continuous mining machine during the advancing movement thereof while the vacuum air circuit is completed therethrough by virtue of said bypass valve means being in said closed position, said telescopic conduit assembly being operable to enable a conduit section to be added to said conduit string when said bypass valve means is in said open position to bypass the vacuum air circuit from said conduit string and said telescopic conduit assembly.

16. A system as defined in claim 15 wherein said separating means comprises a housing having an inlet for a stream of air having coal particles entrained therein, baffle means within said housing in a position to be engaged by said inlet stream of air and entrained coal particles for reducing the velocity energy of said coal particles and causing them to move downwardly in an abrupt change of direction, hopper means below said baffle means for collecting the coal particles moving downwardly from said baffle means, and air outlet means in said housing rearwardly of said baffle means and above said hopper means, said rotary air lock discharge means including a power driven pocketed rotor at the lower end of said hopper means.

17. A system as defined in claim 15 wherein said particle filter means comprises a body having a tangential inlet feed tube, an upwardly extending central air outlet conduit leading to the suction side of said positive displacement pump means, said rotary air lock discharge means comprising a power driven pocketed rotor disposed in a lower apex opening of said body.

18. A system as defined in claim 15 wherein said telescopic conduit assembly includes a fixed pipe section, a movable pipe section telescopically related to said fixed pipe section, and means including an inflatable seal for sealing said telescopically related pipe sections.

19. A system as defined in claim 15 including means for introducing and exhausting air under pressure to said inflatable seal.

20. A system as defined in claim 15 wherein said by-pass valve means in its closed position is retained therein by a predetermined spring pressure yieldable when the vacuum within the system communicating therewith exceeds a predetermined valve.

21. A system as defined in claim 15 wherein a wheeled carriage assembly is fixed to the central portion of each conduit section.

22. A continuous mining machine including a track frame, left and right-hand independently power driven endless track assemblies on said track frame for moving the same in either direction along a mine entry floor and for guiding the same during such movement, a sump frame mounted on said track frame for power driven horizontal reciprocating movement with respect to said track frame and track assemblies, coal cutting and gathering means carried by said sump frame for cutting the coal in a coal seam and for gatheringly moving the cut coal to a discharge position located at the central portion of the machine, an inlet vacuum air duct fixed to said sump frame having a forward inlet opening disposed at said discharge position and a rear end portion of constant cross-sectional configuration, a cooperating duct section fixedly carried by said track frame having a forward end position of constant cross-sectional configuration disposed in telescopic relation with respect to the rear end portion of said inlet duct, and means for sealingly connecting said telescopically arranged portions while permitting telescopic movement to take place in response to the power driven movement of said sump frame.

23. A system as defined in claim 22 wherein said sealing means includes an inflatable annular seal and means for introducing air into said inflatable seal selectively at a plurality of predetermined elevated pressures and atmospheric pressure.

* * * * *